United States Patent [19]

Takeuji

[11] 4,453,690

[45] Jun. 12, 1984

[54] MOUNTING ASSEMBLY FOR COOKING APPLIANCES

[75] Inventor: Koichi Takeuji, Nara, Japan

[73] Assignee: Sharp Kabushiki Kaisha, Osaka, Japan

[21] Appl. No.: 405,247

[22] Filed: Aug. 4, 1982

[30] Foreign Application Priority Data

Aug. 11, 1981 [JP] Japan ..... 56-126509

[51] Int. Cl.[3] ..... A47F 5/00

[52] U.S. Cl. ..... 248/309.1

[58] Field of Search ..... 248/309 R, 313, 311.2, 248/310; 312/245, 246, 242, 248

[56] References Cited

U.S. PATENT DOCUMENTS

| | | | |
|---|---|---|---|
| 2,550,019 | 4/1951 | Murphy | 248/311.2 |
| 3,027,215 | 3/1962 | Duncan | 312/245 |
| 3,212,743 | 10/1965 | Culver | 248/313 |
| 3,627,248 | 12/1971 | Nelson | 248/309 |
| 3,756,453 | 9/1973 | Griffioen et al. | 312/248 |

*Primary Examiner*—William H. Schultz
*Assistant Examiner*—Ramon O. Ramirez
*Attorney, Agent, or Firm*—Birch, Stewart, Kolasch & Birch

[57] ABSTRACT

A combined microwave oven and a range hood, namely a space saver, is mounted on a wall in a kitchen through the use of a mounting assembly. The mounting assembly includes a mounting plate secured to the wall. A pair of engaging projections are formed at the bottom of the mounting plate. A pair of engaging indents are formed at the bottom of a rear wall of the space saver so that the space saver is first supported by the engaging projections and rotated to contact the mounting plate. A coupling member and an engaging member are provided at the space saver and the mounting plate, respectively, so that the space saver is tightly secured to the mounting plate which is secured to the wall.

5 Claims, 8 Drawing Figures

MOUNTING ASSEMBLY FOR COOKING APPLIANCES

BACKGROUND AND SUMMARY OF THE INVENTION

The present invention relates to a mounting assembly for mounting a cooking apparatus on a wall in a kitchen. The present invention relates, more particularly, to a mounting assembly for mounting a combined cooking apparatus such as a combined microwave oven and range hood (which is referred to as a space saver hereinbelow) on a wall in a kitchen.

The combined microwave oven and range hood, namely a space saver, is heavy and is difficult to mount on a wall in a kitchen.

Accordingly, an object of the present invention is to provide a novel mounting/demounting assembly for cooking appliances.

Another object of the present invention is to provide a mounting assembly for mounting a space saver on a wall in a kitchen.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a mounting plate is provided, which is secured to a wall in a kitchen. The mounting plate includes a support member for supporting a body of the space saver.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 7:
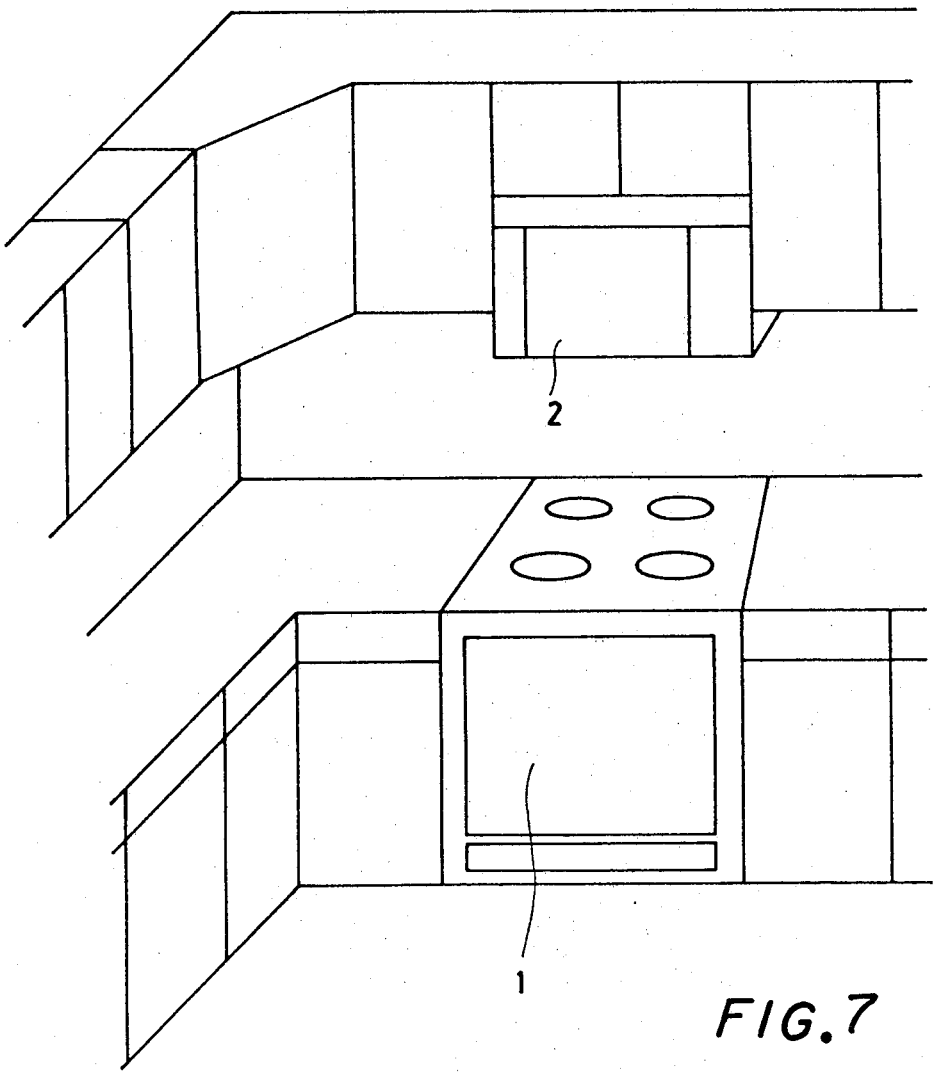
FIG. 7 is a schematic perspective view of a mounted condition of the space saver in a kitchen.

Generally, a space saver 2, which is a combination of, for example, a microwave oven and a range hood, is disposed above a gas range 1 as shown in FIG. 7, and secured to a wall in a kitchen.

Figure 8:
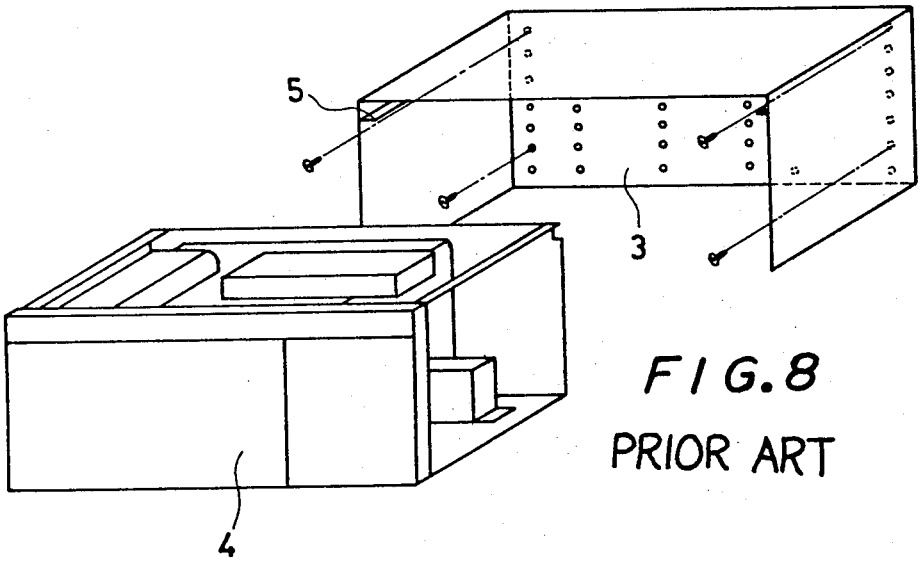
FIG. 8 PRIOR ART
FIG. 8 is an exploded perspective view of a space saver of prior art.

In the conventional system, to mount the space saver 2 on the wall, a cover housing 3 is first demounted from a body 4 of the space saver 2 as shown in FIG. 8. The cover housing 3 is secured to the wall through the use of screws. Then, the body 4 of the space saver 2 is accommodated in the cover housing 3 in such a manner that the body 4 slides on a pair of rails 5 secured to the cover housing 3.

In the above-mentioned conventional system, the mounting operation is troublesome because the cover housing 3 must be demounted from the body 4 of the space saver 2. The internal components disposed in the body 4 are exposed and, therefore, there is a possibility that the internal components may be damaged. Furthermore, lead wires must be correctly connected through the cover housing 3. The above-mentioned mounting operation is difficult to perform because the heavy body 4 of the space saver 2 must be manually supported in a relatively high place and exactly accommodated on the pair of rails 5 provided in the cover housing 3.

Figure 1:
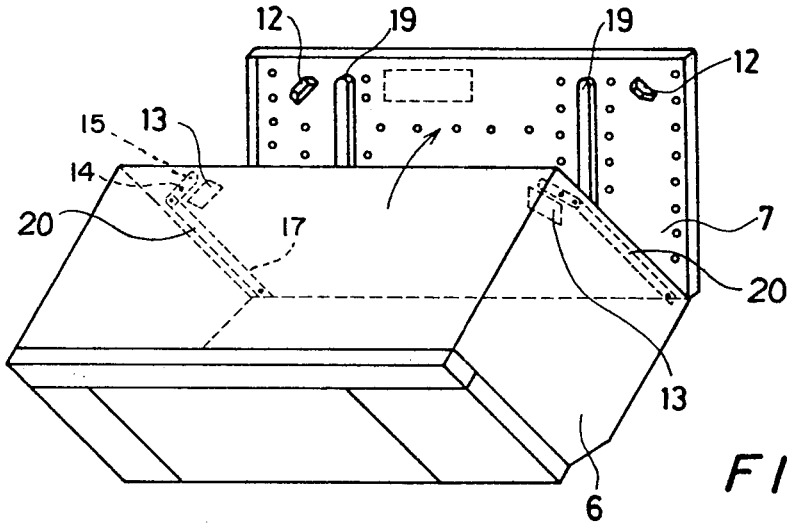
FIG. 1 is a perspective view for explaining a mounting operation of a space saver through the use of an embodiment of a mounting assembly of the present invention.
Figure 2:
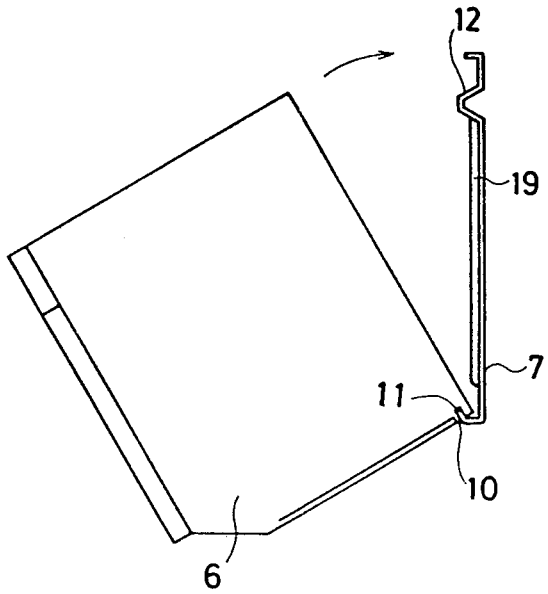
FIG. 2 is a side view of the space saver and the mounting assembly of FIG. 1.

FIGS. 1 and 2 show a mounting operation of a space saver through the use of an embodiment of a mounting assembly of the present invention. The mounting assembly of the present invention includes a mounting plate 7 which is separate from a space saver body or housing 6 and adopted to be secured to a wall in a kitchen, and a coupling member 20 provided at the back of the space saver body 6.

Figure 3:
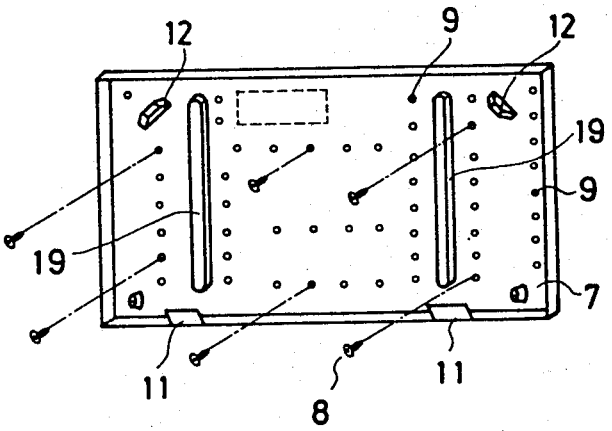
FIG. 3 is a perspective view of a mounting plate included in the mounting assembly of FIG. 1.

FIG. 3 shows the mounting plate 7 which has a plurality of small apertures 9 formed at desired positions. A pair of engaging portions 12 which may be trapezoid in shape with a hollow central portion are formed at both corners of the upper section of the mounting plate 7, and engaging projections 11 are provided at desired positions on the bottom edge of the mounting plate 7. A pair of reinforcing ribs 19 are secured to the mounting plate 7.

A microwave oven and a range hood (not shown) are disposed in the space saver body 6. A pair of apertures 13 are formed in a rear wall of the space saver body 6 at positions corresponding to the engaging portions 12 formed on the mounting plate 7. A pair of coupling members 20 are provided near the respective apertures 13 in order to fix the space saver body 6 to the mounting plate 7. Engaging indents 10 are formed near the bottom edge of the rear wall of the space saver body 6 at positions corresponding to the engaging projections 11 provided on the mounting plate 7. The engaging indents 10 accommodate the engaging projections 11 when the space saver body 6 is mounted on the mounting plate 7.

Figure 4:
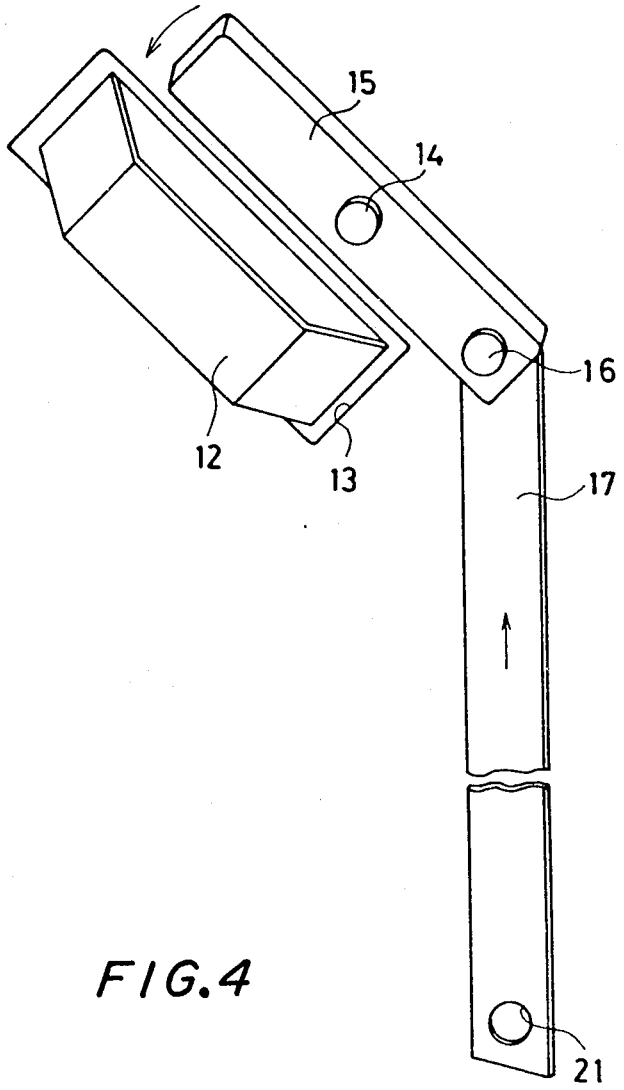
FIG. 4 is a perspective view of an engaging member and a coupling member included in the mounting assembly of FIG. 1.
Figure 5:
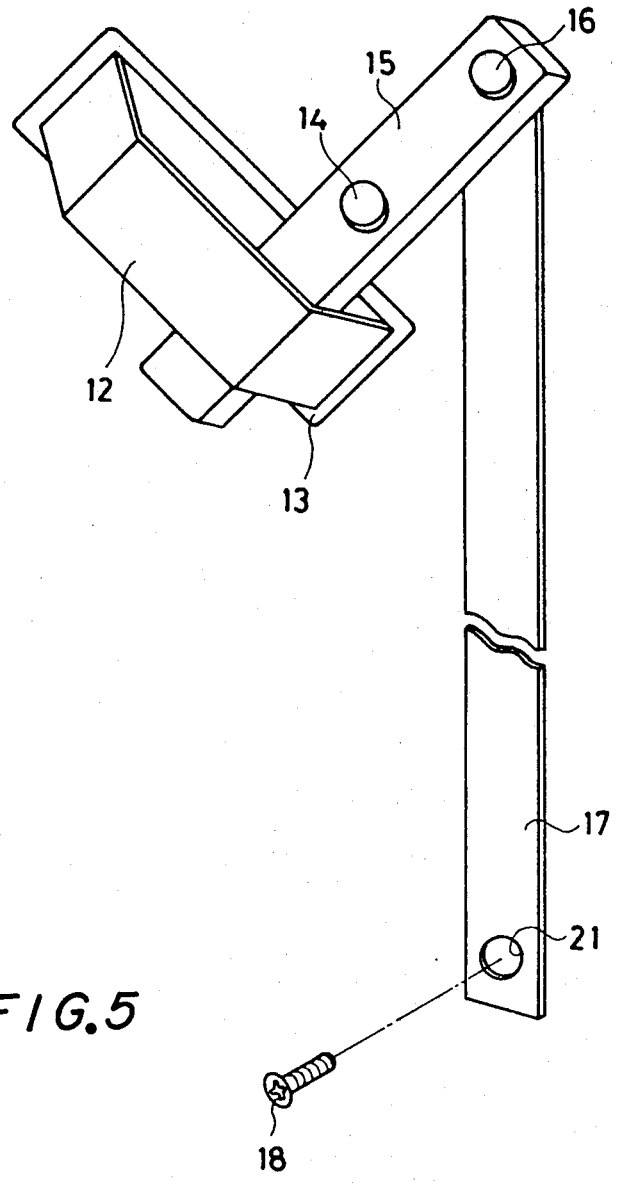
FIG. 5 is a perspective view showing an operational mode of the engaging member and the coupling member of FIG. 4.

The coupling member 20 includes, as shown in FIG. 4, a rotatable rod 15 rotatably secured to a rear wall 6' of the space saver body 6 by a pin 14, and actuating rod 17 rotatably secured to one end of the rotatable rod 15 through the use of a pin 16. The coupling member 20 is constructed so that the rotatable rod 15 is engaged by the engaging portion 12 which is projected through the aperture 13, thereby tightly supporting the space saver body 6 on the mounting plate 7. An opening 21 is formed at one end opposite to the portion where the actuating rod 17 is secured to the rotatable rod 15. The coupling member 20 will be fixed to the inner surface of the rear wall 6' of the space saver body 6 by means of a screw 18 which is disposed through the opening 21 formed in the actuating rod 17 and an opening 22 formed at a desired position in the rear wall 6′ of the space saver body 6.

The mounting operation of the space saver is conducted in the following manner. First, the mounting plate 7 is secured to the wall through the use of screws 8. The space saver body 6 is mounted on the mounting plate 7 in a manner that the engaging projections 11 provided on the mounting plate 7 are accommodated in the engaging indents 10 formed on the space saver body 6 and, then, the space saver body 6 is rotated so that the rear wall 6′ contacts the mounting plate 7. The engaging portions 12 are received through the apertures 13 so that the engaging portions 12 are exposed to the inside of the space saver body 6.

Figure 6:
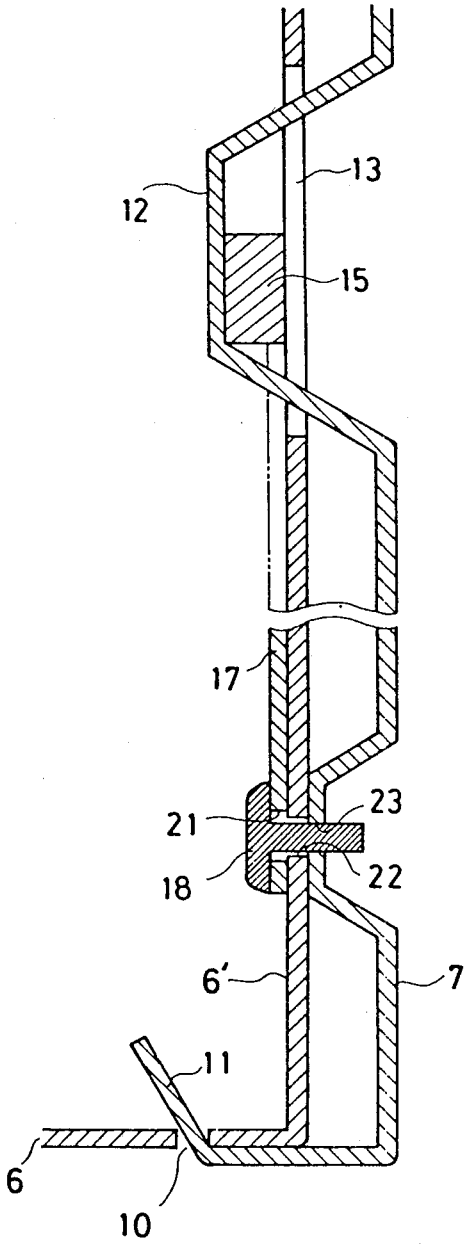
FIG. 6 is a sectional view showing an operational mode of the mounting assembly of FIG. 1.

The rotatable rod 15 is rotated so that the rotatable rod 15 is received by the engaging projection 12. By this rotating movement, the actuating rod 17 is shifted upward till the opening (screwed opening) 21 confronts the opening 22 formed in the rear wall 6′ of the space saver body 6. The screw 18 is disposed through the screwed opening 21 and the opening 22 and, then, reaches a screwed opening 23 formed at the corresponding portion in the mounting plate 7, whereby the rotatable rod 15 is held at the engaged condition with respect to the engaging projection 12 and the space saver body 6 is tightly secured to the mounting plate 7 as shown in FIG. 6.

The demounting operation can be conducted in the reversed order of the mounting operation.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A mounting assembly for mounting a housing on a wall comprising:

a housing;

a mounting plate adapted to be secured to a wall, said mounting plate including an engaging projection formed at a bottom of the mounting plate;

an engaging indent formed at a bottom of said housing in order to accommodate said engaging projection formed on the mounting plate;

an engaging portion formed on said mounting plate;

an aperture formed in a rear wall of said housing at a position corresponding to said engaging portion so that said engaging portion projects into an interior portion of said housing when the housing is mounted on said mounting plate; and a coupling member disposed on the inner surface of said rear wall of said housing, said coupling member being accommodated to retain said engaging portion when said housing is mounted on said mounting plate.

2. A mounting assembly according to claim 1, wherein said engaging portion includes a hollow central portion and said coupling member includes a rotatable rod rotatably secured to said rear wall of said housing and an actuating rod operatively connected to said rotatable rod, wherein imparting movement to said actuating rod rotates said rotating rod to position said rotating rod within said hollow central portion of said engaging portion for retaining said engaging portion and said housing relative to each other.

3. A mounting assembly according to claim 1, wherein said mounting plate includes two engaging projections and two engaging portions and said housing includes two engaging indents and two apertures each engaging projection being operatively positioned relative to respective engaging indents and each engaging portion being operatively positioned relative to respective apertures for positioning said mounting plate relative to said housing.

4. A mounting assembly according to claim 1, wherein said housing is a cooking apparatus.

5. A mounting assembly according to claim 1, and further including retaining means for affixing said coupling member relative to said rear wall of the housing while said engaging portion is retained within said aperture.

* * * * *